US007121696B2

(12) United States Patent
Whitfield, Sr.

(10) Patent No.: US 7,121,696 B2
(45) Date of Patent: Oct. 17, 2006

(54) COVER FOR RECESSED LIGHTING FIXTURE

(76) Inventor: John Lyle Whitfield, Sr., 3502 Stevens Ave. South, Minneapolis, MN (US) 55408

( * ) Notice: Subject to any disclaimer, the term of this patent is extended or adjusted under 35 U.S.C. 154(b) by 79 days.

(21) Appl. No.: 10/916,225

(22) Filed: Aug. 11, 2004

(65) Prior Publication Data

US 2005/0078474 A1 Apr. 14, 2005

Related U.S. Application Data

(60) Provisional application No. 60/494,295, filed on Aug. 11, 2003.

(51) Int. Cl.
*F21S 8/00* (2006.01)

(52) U.S. Cl. ..... 362/365; 362/399; 362/147; 362/364; 362/360

(58) Field of Classification Search ..... 362/364, 362/365, 399, 147, 148, 149, 150, 351, 355, 362/359–362

See application file for complete search history.

(56) References Cited

U.S. PATENT DOCUMENTS

| | | | | |
|---|---|---|---|---|
| 3,518,420 | A * | 6/1970 | Kripp | 362/257 |
| 3,974,373 | A | 8/1976 | Zapolsky | |
| 4,099,224 | A | 7/1978 | Valpey | |
| 4,193,375 | A | 3/1980 | Sharland et al. | |
| 4,248,914 | A | 2/1981 | McClane | |
| 4,697,544 | A | 10/1987 | Stevens et al. | |
| 5,103,762 | A | 4/1992 | Long et al. | |
| 5,285,014 | A | 2/1994 | Gilchrist | |
| 5,309,342 | A | 5/1994 | Heinen, Sr. | |
| 5,354,377 | A | 10/1994 | Jeffrey, Jr. | |
| 5,374,812 | A | 12/1994 | Chan et al. | |
| 5,420,775 | A | 5/1995 | Kusmer | |
| 5,432,979 | A | 7/1995 | Harper | |
| 5,491,618 | A | 2/1996 | Vakil | |
| 5,494,519 | A | 2/1996 | Jeffrey, Jr. | |
| 5,515,252 | A | 5/1996 | Osteen et al. | |
| 5,723,816 | A | 3/1998 | Neece | |
| 5,738,437 | A | 4/1998 | Ilagan | |
| 5,820,247 | A | 10/1998 | Schuler | |
| 5,927,844 | A | 7/1999 | Justiniano et al. | |
| 5,951,139 | A * | 9/1999 | Smith et al. | 362/33 |
| 5,951,151 | A * | 9/1999 | Doubeck et al. | 362/365 |
| 5,965,846 | A | 10/1999 | Shotey et al. | |
| 6,082,871 | A | 7/2000 | Yeh | |
| 6,126,296 | A | 10/2000 | Justiniano et al. | |
| 6,511,343 | B1 | 1/2003 | Shotey et al. | |
| 6,703,562 | B1 | 3/2004 | Pacheco | |
| 6,764,715 | B1 | 7/2004 | Janssen | |
| 2004/0050324 | A1 | 3/2004 | Copp | |

* cited by examiner

*Primary Examiner*—Thomas Sember
(74) *Attorney, Agent, or Firm*—Kinney & Lange, P.A

(57) ABSTRACT

A light cover for protecting recessed lighting fixtures from exposure to fluid during painting or other ceiling treatments has a shield, sized to fit over a baffle and an outer trim of a recessed lighting fixture, and a mounting flange sized to fit within the baffle and frictionally engage the light cover to the baffle. The light cover has a handle located on the shield and the handle is used to engage the flange to the baffle to secure the light cover to the recessed lighting fixture prior to a ceiling treatment. The handle is also used to disengage the flange from the baffle to remove the light cover from the recessed lighting fixture after completion of a ceiling treatment.

16 Claims, 6 Drawing Sheets

COVER FOR RECESSED LIGHTING FIXTURE

CROSS-REFERENCE TO RELATED APPLICATION(S)

Priority is claimed under U.S. Provisional Patent Application Ser. No. 60/494,295 filed on Aug. 11, 2003, entitled "Cover All Recessed Light Paint and Washing Shield" by John Lyle Whitfield, which is incorporated by reference.

BACKGROUND OF THE INVENTION

The present invention relates generally to a cover sized to fit over a recessed lighting fixture. More particularly, the invention relates to a light cover used to protect the recessed lighting fixture and the light bulb from exposure to fluids during painting, power washing or other ceiling treatments.

Before paint or other fluids are applied to a ceiling, any recessed lighting fixtures must be protected from the paint or other fluid. The most common method of protecting the recessed lighting fixtures is to apply masking paper with masking tape to the fixtures. This requires a significant amount of time. In addition, the heat of the light bulbs in the fixtures causes the adhesive on the masking tape to stop working effectively. The combination of the masking paper and heat from the light bulbs presents a fire hazard, especially given the likely presence of flammable paint and other products.

BRIEF SUMMARY OF THE INVENTION

The present invention relates to a light cover to protect recessed lighting fixtures during painting, texturing or cleaning of ceilings. The light cover has a shield that is sized to fit over the outer trim of the recessed lighting fixture. A mounting flange is located on one side of the shield and the flange is sized to fit within the baffle of the recessed lighting fixture. The flange frictionally engages with the baffle to secure the light cover to the recessed lighting fixture. A handle is located on the opposite side of the shield to make it easier for the user to mount the light cover to the recessed lighting fixture and remove the cover from the fixture.

In an exemplary embodiment, the light cover is made of a translucent plastic, which permits light from the light bulb of the recessed lighting fixture to shine through the light cover when the cover is mounted to the fixture. Thus the recessed lighting fixture is still able to supply light to the area in which the ceiling is being painted or otherwise treated.

The light cover is available in various sizes to correspond to the various sizes of standard recessed lighting fixtures.

DETAILED DESCRIPTION

Figure 1:
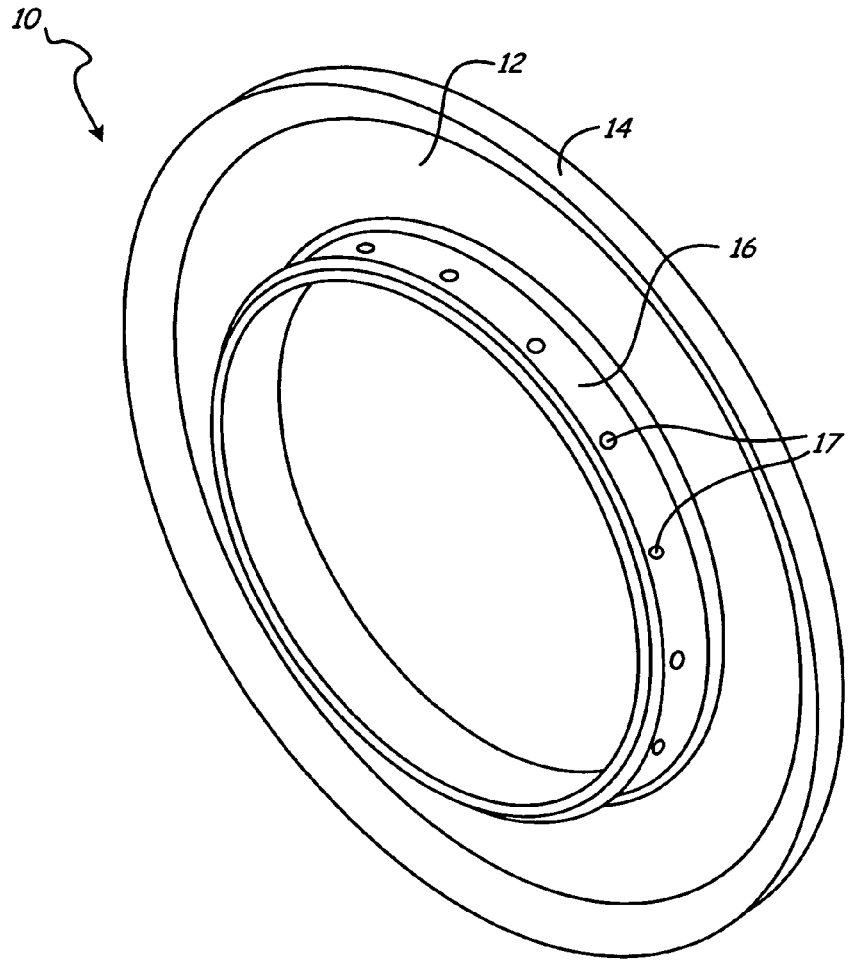
FIG. 1 is a perspective view of a light cover.

FIG. 1 is a perspective view of light cover 10. Light cover 10 includes shield 12, outer lip 14, mounting flange 16, protrusions 17, and handle 18 (shown in FIG. 2). Light cover 10 is sized to mount onto a recessed lighting fixture to protect the fixture during painting, texturing or cleaning of a ceiling in which the fixture is mounted. A first side of shield 12 of light cover 10 engages with the inside portion of a recessed lighting fixture to secure light cover 10 to the fixture. A second side of shield 12 faces away from the recessed lighting fixture such that when light cover 10 is in place to cover the fixture, the second side of shield 12 is visible.

Figure 2:
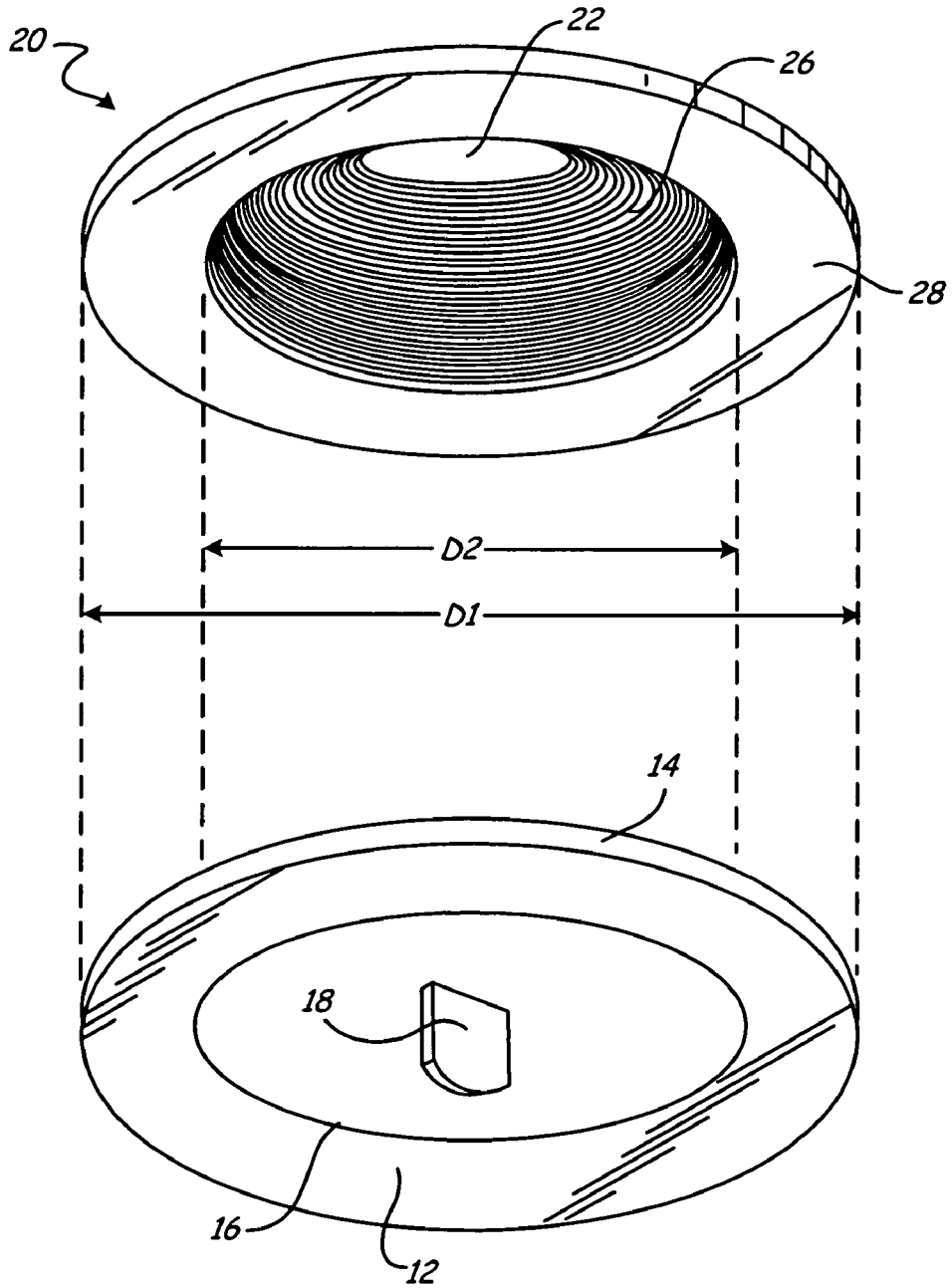
FIG. 2 is a perspective view of a light cover and a recessed lighting fixture before the light cover is inserted into the recessed lighting fixture.

FIG. 2 is a perspective view of light cover 10 and recessed lighting fixture 20 before light cover 10 is inserted into recessed lighting fixture 20. FIG. 2 shows shield 12, outer lip 14, mounting flange 16 and handle 18 of light cover 10. D1 defines the diameter of shield 12 and D2 defines the diameter of mounting flange 16.

Recessed lighting fixture 20 includes light bulb 22, light bulb receptacle 24 (not shown), baffle 26, and outer trim 28. In FIG. 2, baffle 26 has a series of ridges to assist in reducing glare from light bulb 22. However, in this invention, the term baffle is defined as any recessed housing unit which holds the light bulb and the light bulb receptacle. It is not required that the baffle have ridges; the baffle could instead be a smooth surface. Additionally, in this invention, outer trim 28 is not required to be a separate piece of recessed lighting fixture 20. The outer trim could also be connected to the baffle as a single unit.

Shield 12 has a slightly larger diameter (D1) than outer trim 28 of recessed lighting fixture 20. Shield 12 is sized to fit over outer trim 28 and cover recessed lighting fixture 20 to protect recessed lighting fixture 20 from exposure to paint or other fluids during treatment of a ceiling. In a particular embodiment shield 12 is made out of a clear plastic, thus allowing light from light bulb 22 to come through light cover 10 and still supply light to an area where the ceiling is being treated. In some cases this eliminates the need to supply extra lighting to the area.

Outer lip 14 is located around the periphery on the first side of shield 12 to conceal and protect the outer edge of outer trim 28 of recessed lighting fixture 20 from paint or other fluid applied to a ceiling.

Mounting flange 16 is located on the first side of shield 12 and has a slightly smaller diameter (D2) than baffle 26 of recessed lighting fixture 20. Mounting flange 16 is sized to press-fit light cover 10 to recessed lighting fixture 20.

Handle 18 is located in the center of shield 12 on the second side of shield 12. The user holds handle 18 and places mounting flange 16 inside baffle 26. While still holding handle 18, the user turns light cover 10 until mounting flange 16 frictionally engages with baffle 26 and light cover 10 is tightened into place, thereby covering recessed lighting fixture 20. Handle 18 is also used to remove light cover 10 from recessed lighting fixture 20 by disengaging mounting flange 16 from baffle 26.

As shown in FIG. 1, mounting flange 16 includes protrusions 17, which are equally spaced on the outside of mounting flange 16 to improve the ability of mounting flange 16 to grip to baffle 26.

Figure 3:
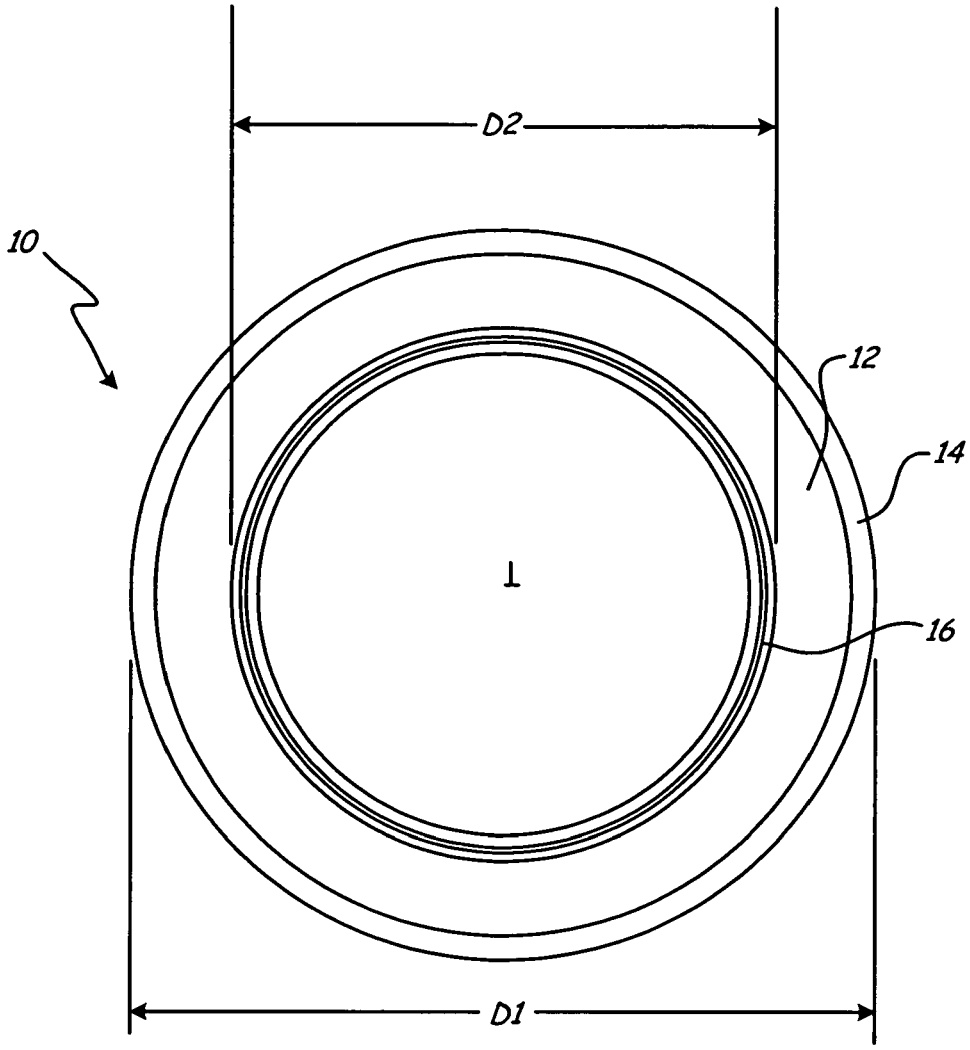
FIG. 3 is a top view of a light cover.

FIG. 3 is a top view of light cover 10 showing the first side of shield 12, outer lip 14 and mounting flange 16. In this particular embodiment, mounting flange 16 is a continuous piece. Mounting flange 16 provides structural strength to hold light cover 10 securely to recessed lighting fixture 20.

It is not required that mounting flange 16 be a single piece. Mounting flange 16 could instead be two or more pieces or segments, so long as mounting flange 16 is able to frictionally engage with baffle 26 and securely mount light cover 10 on recessed lighting fixture 20.

In an exemplary embodiment of light cover 10, D1 is about 7.90 inches and D2 is about 5.63 inches. This particular embodiment is sized to correspond to a specific configuration of a recessed lighting fixture with a given baffle size and a given outer trim size. However, standard recessed lighting fixtures have baffles that range in size from diameters of four to twenty-two inches, depending on the size of the light bulb. In addition, the outer trim piece can come in various sizes. Therefore, it is recognized that the light cover of the present invention can be configured to cover a recessed lighting fixture of any size.

Figure 4:
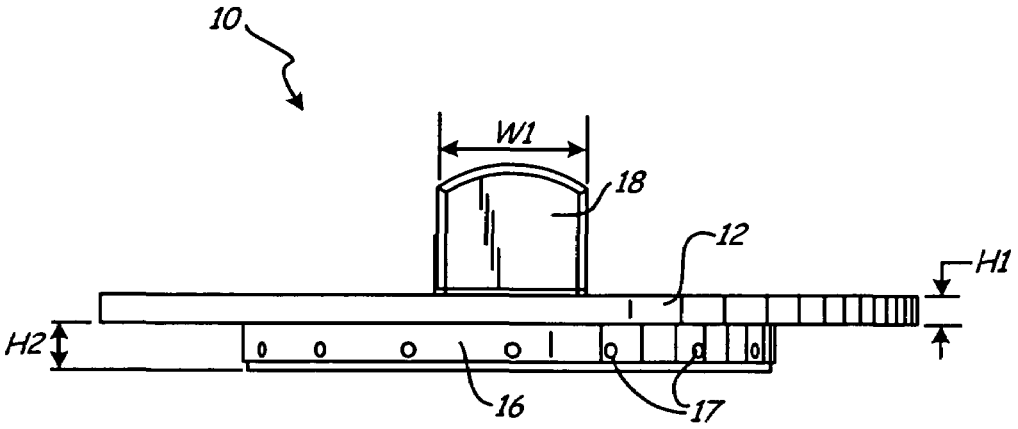
FIG. 4 is a side view of a light cover.

FIG. 4 is a side view of light cover 10. In this particular embodiment, shield 12 has a height (H1) of about 0.18 inches. Workers skilled in the art will recognize that H1 is variable so long as light cover 10 is able to effectively conceal recessed lighting fixture 20. Mounting flange 16 has a height (H2) of about 0.63 inches. Workers skilled in the art will recognize that H2 is also variable so long as mounting flange 16 is substantial enough to frictionally engage with baffle 26. Additionally, in this particular embodiment handle 18 has a width (W1) of about 0.95 inches.

Figure 5:
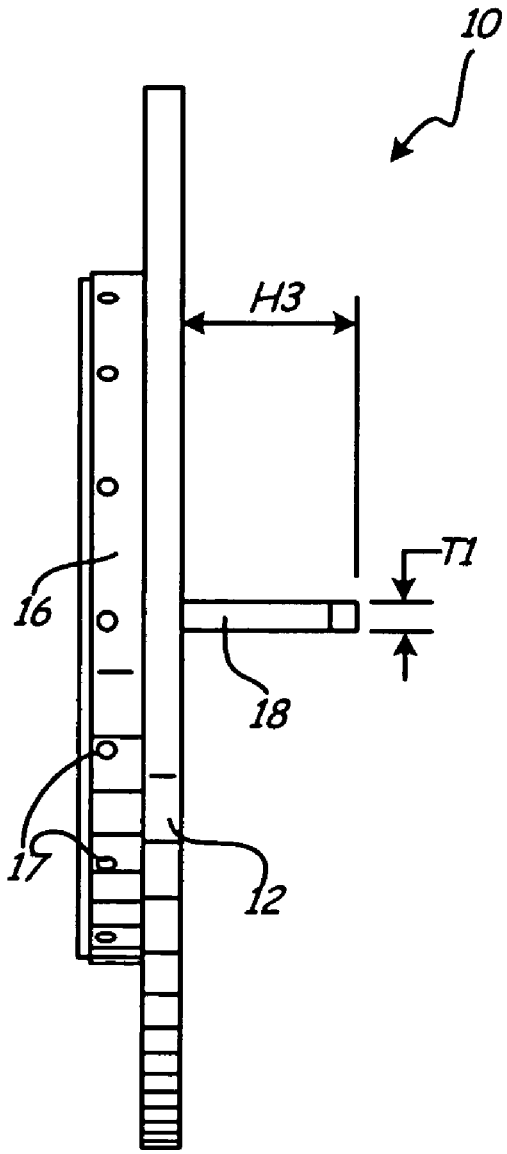
FIG. 5 is a side view of the light cover in FIG. 4 oriented vertically and rotated to show a different side view.

FIG. 5 is a side view of light cover 10 of FIG. 4 oriented vertically and rotated to show a height (H3) and a thickness (T1) of handle 18. In this particular embodiment, H3 is about 0.95 inches and T1 is about 0.25 inches. This embodiment is shown as an example, but it is recognized that the dimensions of handle 18 (W1, H3, T1) are not fixed. The dimensions of handle 18 are limited only by handle 18 being effective in assisting the user to easily and quickly secure light cover 10 to recessed lighting fixture 20 and remove light cover 10 from recessed lighting fixture 20.

The embodiment in FIGS. 3–5 is an illustration of a light cover with dimensions that will cover a recessed lighting fixture of a particular size and configuration. The dimensions of shield 12, mounting flange 16 and handle 18 are meant to vary to correspond to recessed lighting fixtures of different sizes, without losing any of the benefits provided by the embodiment described above.

The light cover in this invention is preferably made of plastic. In a particular embodiment, light cover 10 is made of polyurethane. It is beneficial to make the shield out of a translucent plastic, thereby allowing sufficient light from light bulb 22 (see FIG. 2) to come through light cover 10. Additionally, it is favorable to make light cover 10 out of plastic since plastic is relatively inexpensive and durable. Other materials, such as glass or ceramics, may be used; however, these materials do not have all of the advantages of plastic.

Figure 6:
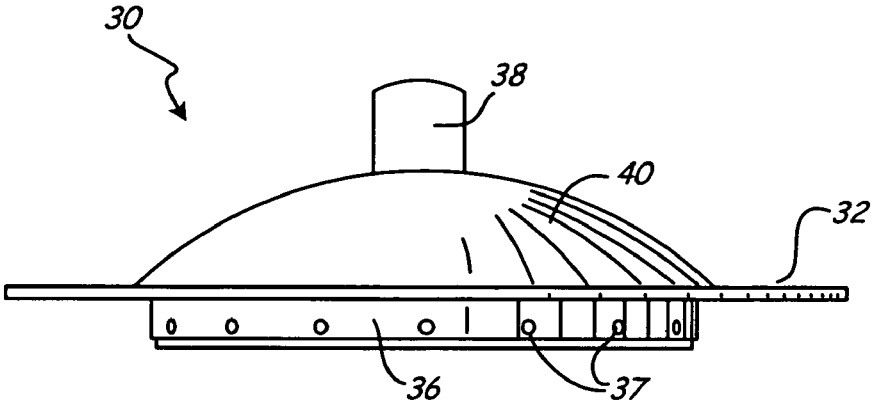
FIG. 6 is a side view of a second embodiment of a light cover.

FIG. 6 is a side view of a second embodiment of a light cover. Light cover 30 includes shield 32, mounting flange 36, protrusions 37, handle 38 and domed portion 40. Light cover 30 is designed such that shield 32 has a dome shaped central portion (domed portion 40) to accommodate both recessed lighting fixtures that have fully recessed lights and recessed lighting fixtures that have bulbs extending out past the plane defined by the ceiling. Shield 32 has a substantially flat surface at the outer circumference generally equal in diameter to the diameter of the outer trim of a recessed lighting fixture. Domed portion 40 of shield 32 is generally equal in diameter to the diameter of the baffle of a recessed lighting fixture. Handle 38 is located in the center of domed portion 40 of shield 32.

This particular embodiment in which the shield has a hollow dome shape also allows for easy stacking of the light covers, especially if the handle is also hollow. In addition, stacked light covers 10 and 30 of the invention can be transported in a cylindrical shaped carrying case.

This invention includes a method of painting or applying a fluid to a ceiling whereby any recessed lighting fixtures of the type having a baffle or an open canister and an outer trim or finishing piece are protected from exposure to paint or other fluids. A light cover as described above can easily be placed over each recessed lighting fixture in the area where the ceiling is to be painted, washed or otherwise treated. After the light cover is in place, thereby concealing the recessed lighting fixture from exposure to fluid, the paint or other fluid can easily and quickly be applied to the ceiling. The light covers can then easily be removed from each recessed lighting fixture. The light covers can be disposed of or cleaned and saved for reuse.

Although the present invention has been described with reference to preferred embodiments, workers skilled in the art will recognize that changes may be made in form and detail without departing from the spirit and scope of the invention.

The invention claimed is:

1. A light cover for protecting recessed lighting fixtures of a type having a baffle which holds a light bulb and a light bulb receptacle and an outer trim surrounding the baffle that is generally flush with the ceiling, the light cover comprising:

a shield sized to fit over the baffle and the outer trim of the recessed lighting fixture;

a mounting flange located on a first side of the shield and sized to fit within the baffle and frictionally engage the light cover to the baffle; and a handle located on a second side of the shield, wherein the handle is gripped when engaging the mounting flange to the baffle to secure the light cover to the recessed lighting fixture and when disengaging the mounting flange from the baffle to remove the light cover from the recessed lighting fixture.

2. The light cover of claim 1, wherein the shield has a hollow dome portion.

3. The light cover of claim 1, wherein the handle is hollow such that a plurality of light covers can be stacked onto each other.

4. The light cover of claim 1, wherein the shield comprises an outer lip along a periphery of the shield.

5. The light cover of claim 4, wherein the outer lip has a height sufficient to protect an outer edge of the outer trim from exposure to fluids.

6. The light cover of claim 1, wherein the shield, the mounting flange and the handle are made of plastic.

7. The light cover of claim 1, wherein the shield is translucent.

8. The light cover of claim 1, wherein the shield has a diameter of about 7.90 inches and the mounting flange has a diameter of about 5.63 inches.

9. The light cover of claim 1, wherein the mounting flange has a height of about 0.63 inches.

10. The light cover of claim 1, wherein the mounting flange includes protrusions equally spaced around an outside surface of the mounting flange to help engage the light cover to the baffle.

11. A method of applying a fluid to a ceiling, the method comprising: inserting a first portion of alight cover into a recessed lighting fixture to frictionally engage a baffle of the recessed lighting fixture to hold the light cover in place so that a second portion of the light cover conceals the recessed lighting fixture from exposure to the fluid, wherein the second portion of the light cover comprises a shield sized to fit over the baffle and an outer trim of the recessed lighting fixture, and the first portion of the light cover comprises a mounting flange located on a first side of the shield and sized to fit within the baffle of the recessed lighting fixture and frictionally engage the light cover to the recessed lighting fixture;

applying the fluid onto the ceiling; and removing the light cover from the recessed lighting fixture by disengaging the first portion of the light cover from the recessed lighting fixture.

12. The method of claim 11, wherein inserting a first portion of the light cover into the recessed lighting fixture comprises gripping a handle located on the second portion of the light cover.

13. The method of claim 11, wherein the light cover comprises a lip along a periphery of the shield.

14. The method of claim 11, wherein the shield is translucent.

15. The method of claim 11, wherein the mounting flange includes a plurality of protrusions equally spaced around an outside surface of the mounting flange to help engage the light cover to the baffle.

16. A method of applying a fluid to a ceiling, the method comprising:

inserting a first portion of a light cover into a recessed lighting fixture by gripping a handle located on a second portion of the light cover to frictionally engage a baffle of the recessed lighting fixture to hold the light cover in place so that the second portion of the light cover conceals the recessed lighting fixture from exposure to the fluid;

applying the fluid onto the ceiling; and removing the light cover from the recessed lighting fixture by disengaging the first portion of the light cover from the recessed lighting fixture.

* * * * *